United States Patent [19]

Olrik et al.

[11] 4,080,681

[45] Mar. 28, 1978

[54] BRIDGE

[76] Inventors: Hans H. Olrik, Landemaerket 9, DK-1119, Copenhagen K, Denmark; Hans C. L. Jacobsen, c/o Christiani & Nielsen S.A., Avenida Rio Branco 311, 9 and., Rio de Janiero, Brazil

[21] Appl. No.: 782,328

[22] Filed: Mar. 29, 1977

[51] Int. Cl.[2] ..... E01D 1/00

[52] U.S. Cl. ..... 14/1; 52/588

[58] Field of Search ..... 14/1, 73, 69.5, 17; 52/731, 588, 503

[56] References Cited

U.S. PATENT DOCUMENTS

| | | | |
|---|---|---|---|
| 845,897 | 3/1907 | Richardson | 14/1 |
| 2,336,622 | 12/1943 | Le Tourneau | 14/1 |
| 3,066,771 | 12/1962 | Wolchuk | 14/73 X |
| 3,182,343 | 5/1965 | Larson | 14/69.5 |
| 3,296,759 | 1/1967 | Pavlecka | 52/731 X |
| 3,385,182 | 5/1968 | Harvey | 404/35 |
| 3,386,221 | 6/1968 | Giovannucci | 52/588 X |
| 3,423,780 | 1/1969 | Alten | 14/69.5 |
| 3,517,791 | 6/1970 | Miles | 14/69.5 X |
| 3,706,125 | 12/1972 | Hopkins | 14/1 X |
| 3,984,961 | 10/1976 | Chieger | 404/35 X |

*Primary Examiner*—Nile C. Byers

*Attorney, Agent, or Firm*—Mason, Fenwick & Lawrence

[57] ABSTRACT

A pedestrian bridge includes side, bottom and rail members formed of extruded aluminum box beams welded along edges to define a U-shaped bridge having lights in a longitudinal cavity in the rail members; a second embodiment is in the form of a close pipe of irregular hexagonal cross-section.

9 Claims, 5 Drawing Figures

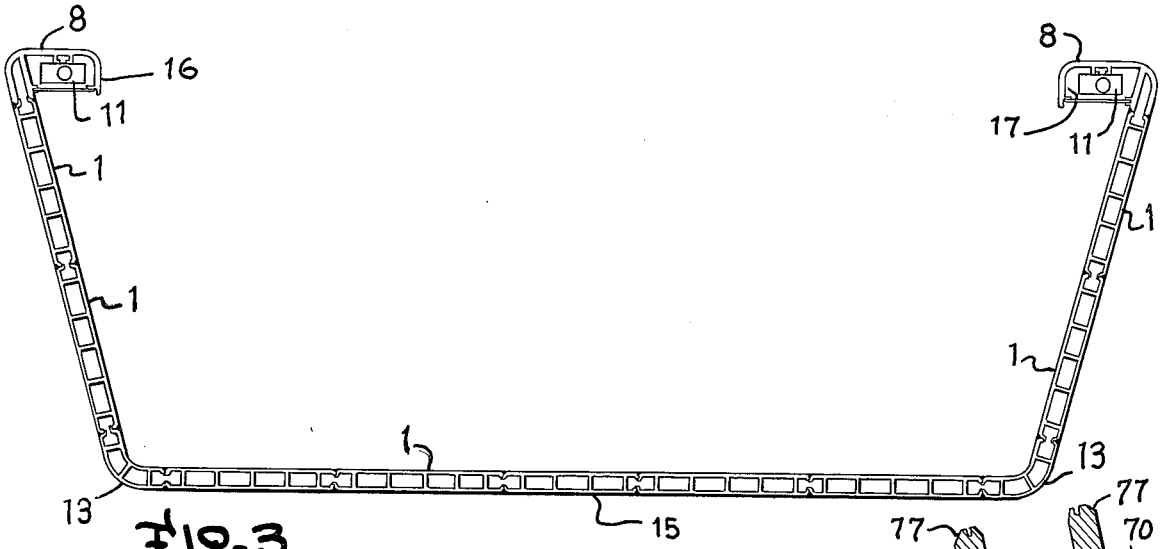
Fig-3
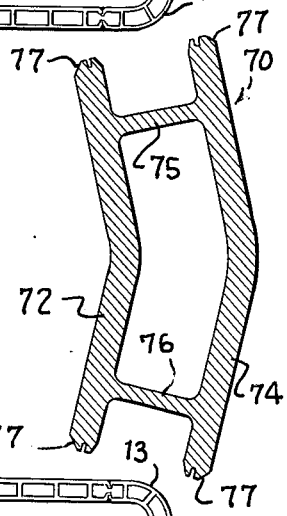
Fig-5
Fig-4
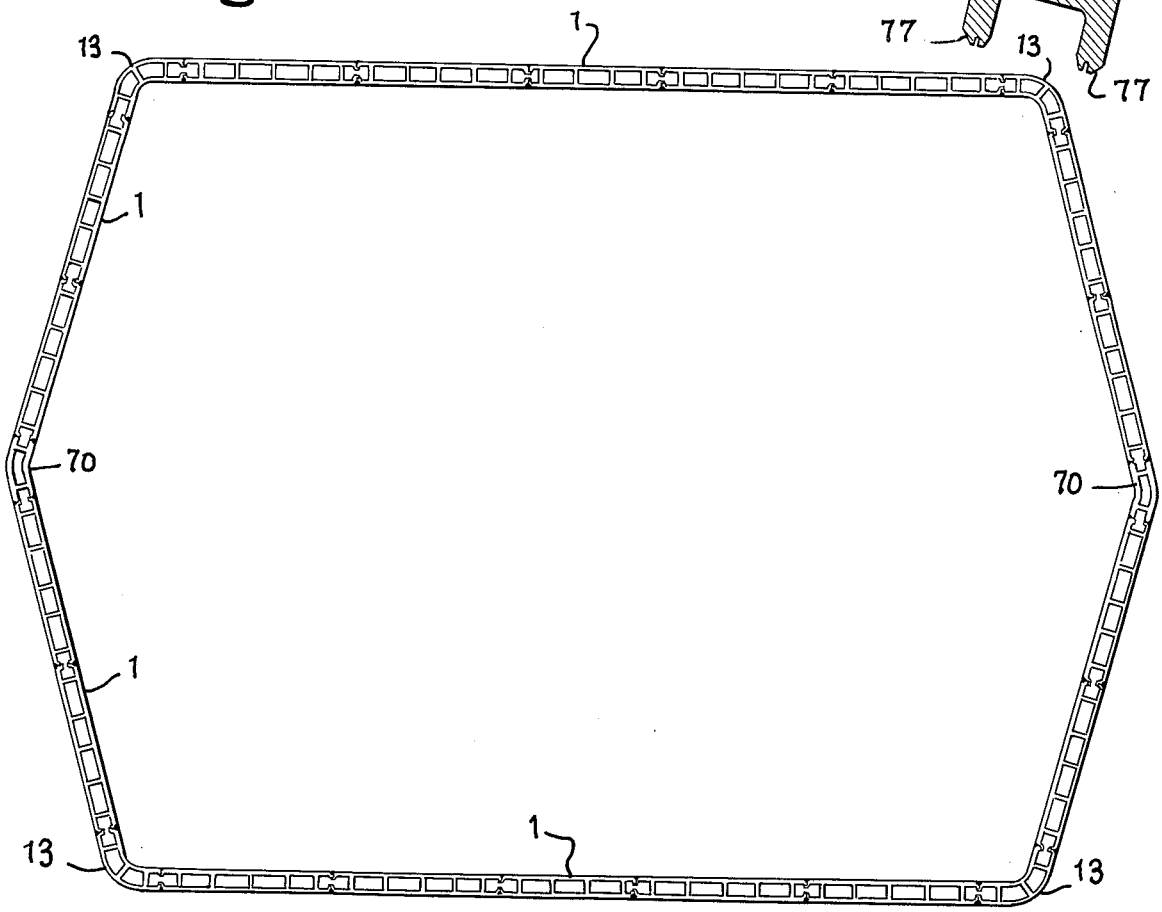

BRIDGE

This invention relates to bridge constructions and is preverably directed to a pedestrian bridge consisting of self-supporting beam type sections supported at intervals preferably near the ends thereof.

Previous bridge constructions have been formed by assembly of the numerous component parts on the bridge site by expensive skilled laborers. Moreover, such bridges are frequently formed of materials such as steel or wood which requires constant and expensive maintenance procedures to avoid deteriorating due to the effects of rain, wind and sun.

Therefore, the principle object of the present invention is to provide a new and improved bridge, which can easily be manufactured in a factory by means of machines and transported to the site so as to reduce the labor costs of fabrication and assembly.

A further object is to provide a bridge which can easily be transported and which is easy to assemble at the location where it is to be erected.

A third object of the invention is to provide a bridge which employs unique modern principles of box beam construction to provide a lightweight and economical bridge.

Achievement of the foregoing objects is achieved by a bridge is characterized in that it employs self-supporting sections in cross section consisting of box beams of extruded metal, preferably aluminum. The self-supporting sections are preferably of U-shaped configuration but can be in the form of closed longitudinal box beams; in either case a very light and stable construction is obtained, of which construction the individual component can easily be produced by means of an extrusion process.

According to the invention, the individual box beam elements are welded together for the construction of the U-shaped cross section. In this way, the parts can be assembled in a simple manner by welding in connection with the mounting.

A preferred embodiment is characterized in that the box beam elements placed at the upper edges of the U-shaped part are designed with an inwardly protruding flange, which is bent downwards at the inner edge so that a construction with a railing or a banister is obtained in a simple way. Moreover, the railing or banister works at the same time as a reinforcement against buckling of the side walls.

According to another aspect of the invention, lighting fixtures can be placed in the longitudinal space under the inwardly protruding flange. In this simple manner, lighting fixtures can be built suitably into closed weathertight spaces.

Finally, a second embodiment of the bridge is characterized in that the adjoining box beams, i.e. the bridge itself, form a closed pipe. In this way, an optimal utilization of the material is obtained by means of the principles for modern shell constructions and the bridge is made very light while affording protection from the weater for users.

A better understanding of the invention will be achieved when the following detailed description is considered in conjunction with the appended drawings in which:

FIG. 3 is an end view of a complete U-shaped bridge element of the type partially illustrated in FIG. 2;

FIG. 4 is a transverse cross section of another embodiment of a bridge according to the invention which is in the form of a closed pipe; and FIG. 5 is an enlarged transverse section of one of the elements employed in the bridge of FIG. 4.

Figures 1, 2:
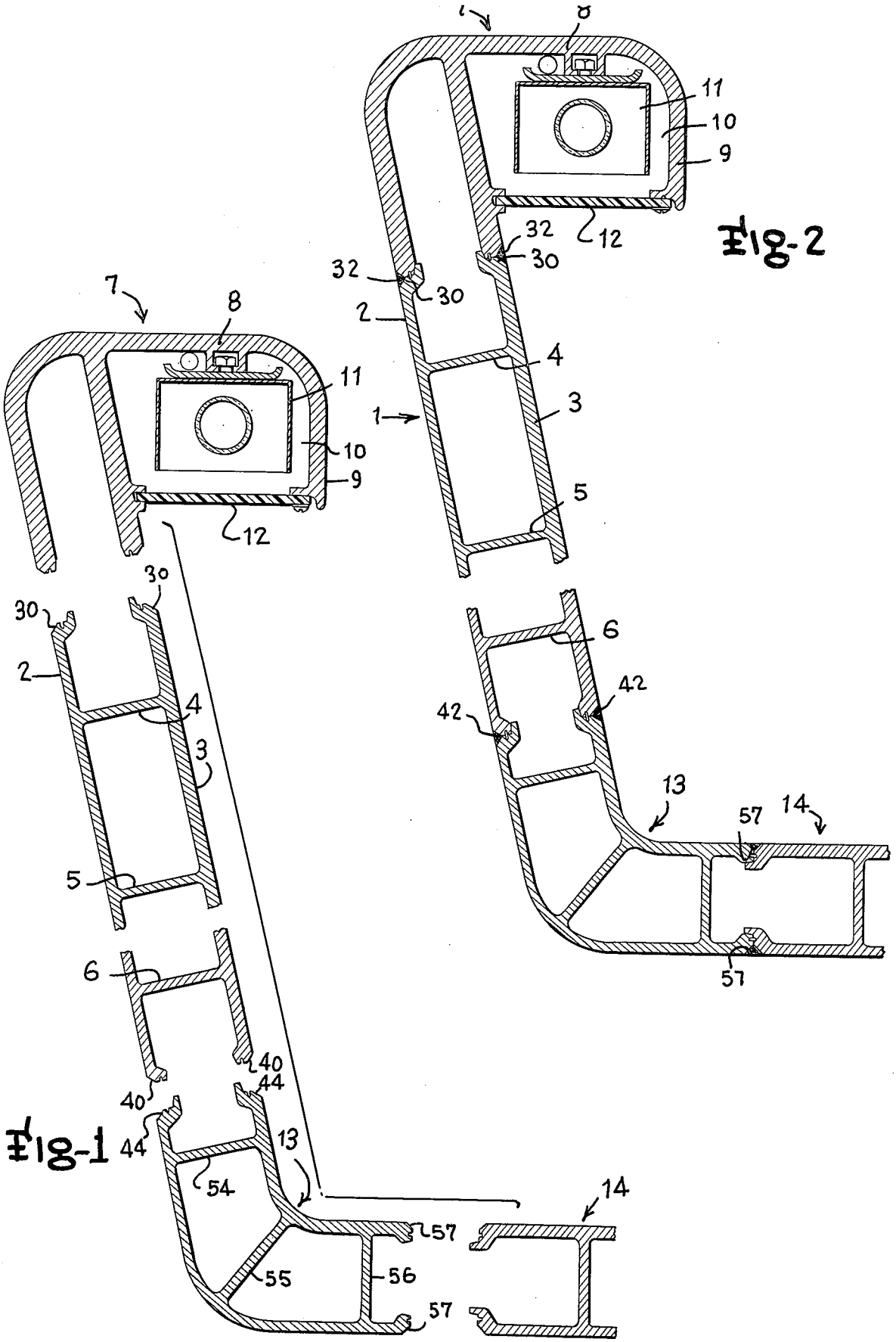
FIG. 1 is an exploded view of a part of a transverse cross section of a bridge component according to the invention.
FIG. 2 is an assembled transverse cross section of a U-shaped bridge according to the invention.

FIG. 1 shows a linear side element 1 consisting of two parallel plate components 2 and 3, which are connected with internal transverse walls 4, 5 and 6 with the number of internal transverse walls varying with the height of linear side element 1. The side element 1 is made of aluminum and is extruded in a direction perpendicular to the paper. The side element is arranged to be welded along upper edges 30 by welds 32 to a railing or a banister element 7 provided with an inwardly protruding flange 8, which at its inner end 9 is bent downwards for the forming of a cavity 10 in which a lighting fixture 11 is provided. The lower edge of cavity 10 is covered by a light permeable plate 12.

At its lower edges 40 the linear side element 1 is in a corresponding way arranged to be welded at 42 to upper edges 44 of a curved corner element 13 as shown in FIG. 2. The curved corner element 13 consists, like the linear side element 1, of a pair of plate components 50 and 52 joined by transverse internal walls 54, 55 and 56. Between the railing or banister element 7 and the corner element 13 there might very well indeed be placed more linear side elements 1 in continuation of each other. Furthermore, the corner element 13 is arranged to be welded along edges together with a bottom element 14, which can be a standard element 15 of the same construction as the linear side element 1. These parts will then together form one side of the cross section of the bridge as shown in FIG. 2, and it is obvious that the same kind of elements can be applied on the other side of the vertical plane of symmetry of the bridges as shown in FIG. 3, which shows a cross section of such a U-shaped bridge in the form of an integral construction of U-shape. The upper ends of the side walls are designed with inwardly protruding flanges 16 and 17 corresponding to the flanges 8 in FIG. 1.

FIG. 4 shows an embodiment of the bridge where the cross section of the bridge is a closed irregular hexagon pipe built of box beams of the type illustrated in the preceeding figures and also employing an intermediate extruded bend element 70 illustrated in FIG. 5. Intermediate bend element 70 includes parallel side plates 72 and 74 joined by transverse internal plates 75 and 76 and edges 77 capable of being welded to linear side elements 1 to form the box-like closed construction illustrated in FIG. 4.

Numerous modifications of the subject invention will undoubtedly occur to those of skill in the art. For example, while elements 1, 7, 13, 14, 72 etc. are preferably formed of extruded aluminum, other materials might be substituted. Therefore, it should be understood that the spirit and scope of the invention is to be limited solely by the appended claims.

We claim:

1. A bridge beam section comprising first and second spaced linear side elements, a bottom element positioned between lower edge portions of said linear side elements, said linear side elements including a unitary extruded box beam comprising two parallel plate components consisting of an inner plate and an outer plate and internal transverse walls perpendicular to and connecting said plate components and lower curved corner elements formed of extruded metal having an inner corner plate and an outer corner plate joined by transverse internal walls for connecting the lower edges of said linear side elements to said bottom element.

2. The invention of claim 1 wherein said bottom element is formed of extruded metal including a unitary extruded box beam having an upper plate and a lower plate joined by vertically oriented transverse walls.

3. The invention of claim 2 wherein said box beam of said linear side element and said box beam of said bottom element are of essentially identical construction.

4. The invention of claim 1 additionally including a bannister element attached to the upper edge of said side elements, each of said bannister elements comprising a unitary extruded member including a bannister inner plate and a bannister outer plate and an inwardly extending generally horizontal flange having a downwardly bent inner end which cooperates with said bannister inner plate to define an elongated downwardly facing longitudinal space and lighting fixture means mounted in said elongated downwardly facing longitudinal space.

5. The invention of claim 4 wherein said box beams, said upper and lower curved corner elements and said bannister elements are formed of aluminum components welded together to provide a unitary structure.

6. The invention of claim 1 wherein said bridge section is of U-shaped transverse sectional configuration.

7. The invention of claim 1 wherein said linear side elements each comprise two of said box beams consisting of an upper box beam and a lower box beam, an extruded bend element welded between said upper and lower box beams, said bottom element comprising a plurality of box beams identical to said box beams of the linear side elements which are welded together to define said bottom element and further including a plurality of said box beams welded together to define a linear roof section parallel to said bottom element and upper curved corner elements identical to said lower curved corner elements welded between the upper box beams of the side elements and the roof section whereby said bridge has a transverse cross section in the form of an irregular hexagon.

8. The invention of claim 7 wherein said extruded bend elements include an inner plate and an outer plate and transverse internal plates connecting said inner plate and said outer plate.

9. The invention of claim 8 wherein said bannister element, said box beams and said curved corner elements are formed of aluminum components welded together to provide a unitary structure.

* * * * *